US005526988A

United States Patent [19]

Rine

[11] Patent Number: 5,526,988

[45] Date of Patent: Jun. 18, 1996

[54] COMMINUTING APPARATUS WITH TANGENTIALLY DIRECTED DISCHARGE

[76] Inventor: James Rine, 1016 Lake Montgomery Dr., Lake City, Fla. 32025

[21] Appl. No.: 346,544

[22] Filed: Nov. 29, 1994

[51] Int. Cl.[6] ..... B02C 13/284; B02C 23/00

[52] U.S. Cl. ..... 241/23; 241/27; 241/73; 241/82; 241/88.4; 241/189.1

[58] Field of Search ..... 241/23, 24, 27, 241/26, 73, 79, 79.1, 82, 88.4, 189.1, DIG. 37

[56] References Cited

U.S. PATENT DOCUMENTS

| | | | |
|---|---|---|---|
| 1,422,761 | 7/1922 | Hartman | 241/82 X |
| 2,012,416 | 8/1935 | Bartels | 241/89.1 X |
| 2,215,226 | 9/1940 | Meyer | 241/88.4 |
| 2,317,909 | 4/1943 | Gruendler | 241/88.4 |
| 2,734,686 | 2/1956 | Oberhellmann | 241/82 X |
| 3,090,568 | 5/1963 | Wetmore | 241/73 |
| 3,965,267 | 6/1976 | Davis | 241/DIG. 37 X |
| 5,044,567 | 8/1991 | Hte et al. | 241/88.4 X |
| 5,199,653 | 4/1993 | Durrant et al. | 241/88.4 X |
| 5,429,314 | 7/1995 | Popovich | 241/88.4 |

FOREIGN PATENT DOCUMENTS

| | | | |
|---|---|---|---|
| 3905682 | 8/1990 | Germany | 241/88.4 |

OTHER PUBLICATIONS

Bantum™ Mikro-Pulverizer Bulletin 51F2, MikroPul, Division of the Slick Corp., Summit, N.J. (1970).

*Primary Examiner*—Timothy V. Eley
*Attorney, Agent, or Firm*—Barnes & Thornburg

[57] ABSTRACT

A comminuting apparatus is provided for use in an impact pulverizer. The comminuting apparatus includes a cover defining a grinding chamber and a support frame connected to the cover and defining a discharge space. A series of spaced-apart bars is circumferentially angled about a generally cylindrical path positioned between the grinding chamber and the discharge space. Each pair of bars in the series of bars defines a material discharge gap and the series of bars defines a series of spaced-apart material discharge gaps between the bars. Each gap defines a flow path having an inner side in fluid communication with the grinding chamber and an outer side in fluid communication with the discharge space. Each flow path extends in a direction generally parallel to a tangent to the cylindrical path defined at the inner side of each respective flow path.

50 Claims, 2 Drawing Sheets

COMMINUTING APPARATUS WITH TANGENTIALLY DIRECTED DISCHARGE

BACKGROUND AND SUMMARY OF THE INVENTION

The present invention relates to comminuting apparatuses, more particularly to comminuting elements for impact pulverizing machines, and most particularly to an element which both comminutes and releases reduced fine particles in an impact pulverizing machine.

Size reduction apparatuses are available in the marketplace for reducing the size of materials such as food products, chemicals, rubbers, and resins. For example, granulators typically cut the material from several inches to as fine as 20 mesh (U.S. Standard). It is often desirable, however, to reduce the size of the materials down to approximately 40 to 60 mesh. Impact pulverizing machines are often used to achieve this further reduction in material size. See, for example, The Bantam™ Mikro-Pulverizer Bulletin 51F2, MikroPul, Division of the Slick Corp., Summit, N.J. (1970). These impact pulverizers break apart materials by rendering an instantaneous blow from a moving body hitting another body.

Conventional impact pulverizing machines typically include a grinding chamber with high speed rotating beaters to break up the materials. The broken materials having a selected reduced fineness fall through a perforated thin metal screening element and pass out from the grinding chamber. Conventional screening elements for pulverizing machines are generally well-known items and are currently in widespread use. See, for example, herringbone slots, round perforations, and cross slot perforation screens in the Bantam™ Mikro-Pulverizer Bulletin 51F2, (supra). Conventional sheet screens, however, readily deform and tear when struck with large unreduced materials at high rates of speeds. A deformed or torn screen produces contaminated product due to larger sized particles passing therethrough. Therefore, the torn screens must be immediately replaced. In fact, it is common for users of pulverizing machines to keep a multitude of screens in stock in anticipation of constant replacement of the screens.

Jump-gap screens are also known in the marketplace, see, The Bantam™ Mikro-Pulverizer, Bulletin 51F2, (supra). A significant disadvantage accompanying the jump-gap screen is that it is ineffective for a variety of grinding applications. Extremely course materials often pass through the jump-gap screen before size reduction occurs. Although conventional screening elements are currently in widespread use, it would be desirable to develop an element which is durable enough to withstand impact by large materials, retains even extremely coarse materials within the grinding chamber for size reduction, and is itself formed to reduce the particle size of the materials.

The present invention is directed accordingly to a comminuting apparatus which replaces conventional screening elements used in impact pulverizing apparatuses with a grinding chamber, rotating beaters, and a support frame. A comminuting apparatus having features of the present invention comprises a series of bars circumferentially angled about the periphery of the grinding chamber generally parallel to the tangent of the rotation path of the beaters. So, a material approaching the apparatus contacts the series of bars such as a stone strikes a wall and the angle of this wall is such as to shatter the material and to deflect the material toward the rotating beaters.

The present invention which comprises the series of bars is formed so that adjacent bars are coupled together in generally parallel overlapping relationship to form a material discharge gap between the adjacent bars. Thus, a flow path for the reduced fine material is positioned generally parallel to the tangent of the rotation path of the beaters. Material which has been shattered by the beaters and/or the bars is carried by high velocity currents created by the rotating beaters through the flow path. The comminuting apparatus in accordance with the present invention may also be referred to in this description and otherwise as a combination screen for an impact pulverizing apparatus.

Various materials have different tendencies to shatter within the grinding chamber. Some materials, in fact, begin to melt and become semi-plastic with repeated energy input by repeated blows by beaters. So, it may be preferable to include a material discharge portion in the apparatus adjacent to the series of bars to discharge such undesirable materials. The material discharge portion includes curved branches extending away from the series and toward the frame and a material discharge aperture extending between the branches. Soft and gummy materials are preferably discharged from the grinding chamber because they often bounce off of the bars and the rotating beaters rather than shatter into reduced materials. This bouncing adds heat to the system and could lead to clogging of the flow path and the gumming up of the remaining material in the system. Thus, soft materials are automatically released from the grinding chamber through the material discharge aperture after approximately one pass across the series of bars.

The present invention is further directed to a method for reducing the particle size of materials in a pulverizing machine which includes an inlet end and a material discharge end. The method includes inserting the material to be reduced into the inlet end of the pulverizer. The material enters the chamber and falls into the rotation path of the beaters where it is struck with the beaters and transformed to a reduced fineness. That material is then impacted against a series of bars, each bar having an impact edge generally perpendicular to the rotation path of the beaters, a radially inner side circumferentially angled about the periphery of the grinding chamber generally parallel to the tangent of the beating means, and an opposite radially outer side.

After impacting the bars, the material having the selected reduced fineness passes between the adjacent bars and exits the pulverizer through the discharge end. The materials having a size greater than that of the selected reduced fineness, however, are deflected off of the impact edge and into the rotation path of the beaters to repeat the grinding procedure. Since it is necessary that the materials be embrittled to shatter them in the grinding chamber, it may be preferable to cool organic materials until they are near or below the glass transition temperature (Tg) of said organic material. The material is contacted with a cooling compound, preferably gaseous or liquid nitrogen, or gaseous or solid $CO_2$ "dry ice" before being placed into the grinding chamber.

Other objects and features of the present invention will become apparent as this description progresses.

DETAILED DESCRIPTION OF THE DRAWINGS

Figure 1:
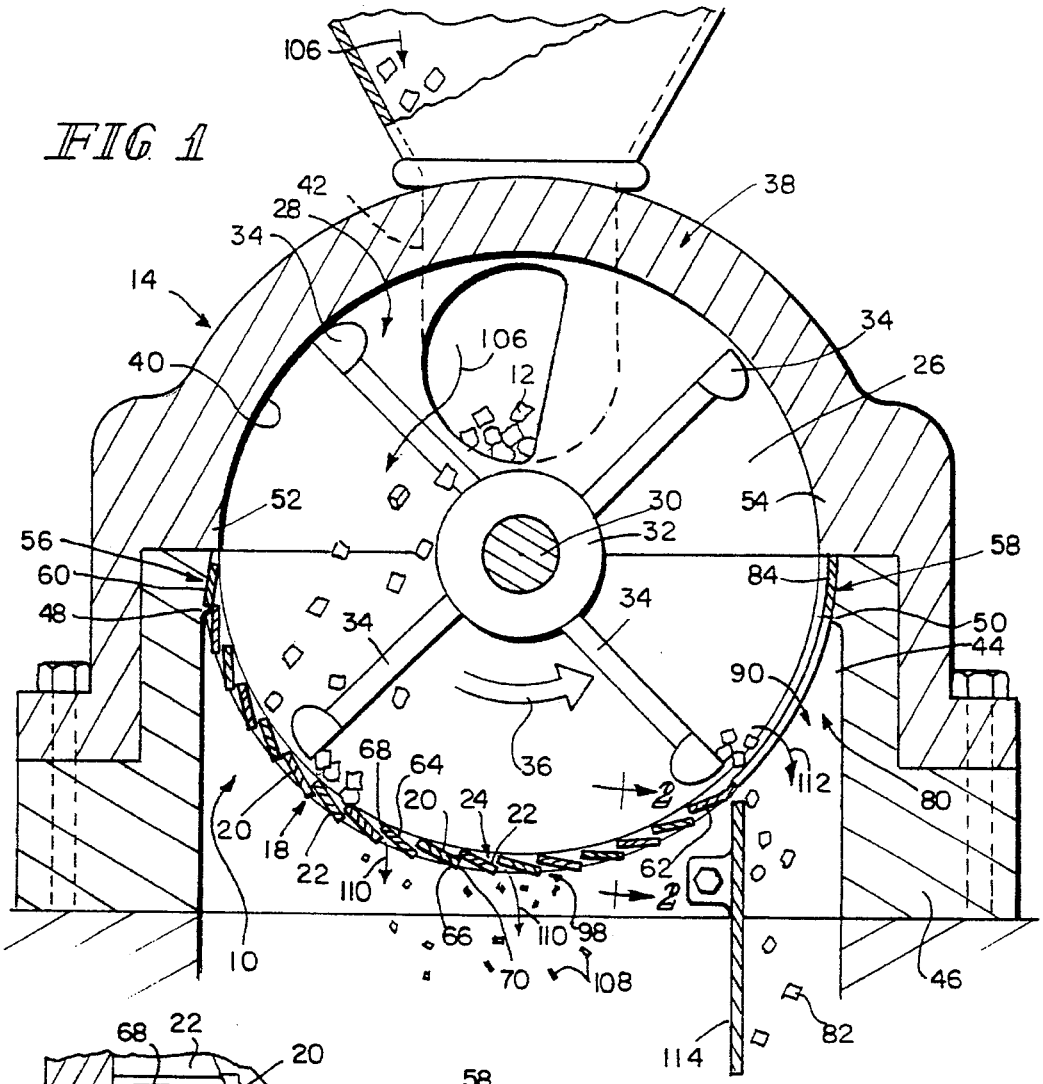
FIG. 1 is a sectional view showing an impact pulverizer with a comminuting apparatus in accordance with the present invention and showing the comminuting apparatus having a series of bars arranged in general overlap relation to one another and a material discharge portion.

A comminuting apparatus 10 and method in accordance with the present invention breaks apart and releases materials 12 in an impact pulverizing machine 14. The comminuting apparatus 10 is shown in FIG. 1 as it would appear to a user after it has been mounted within the impact pulverizing machine 14. The apparatus 10 comprises a series of bars 18 coupled together in a (generally parallel) overlapping relationship. Each leading bar 20 in the series 18 is positioned so that an adjacent bar 22 generally overlaps the leading bar 20. Moreover, the series of bars 18 are positioned so that a material discharge gap 24 is formed between adjacent bars 20, 22 in the series 18.

The comminuting apparatus 10 is formed to be securely attached within a wide variety of impact pulverizers 14 configured to support conventional screen elements (not shown) in the same general position. Illustratively, the well known pulverizer 14 includes a circumferential grinding chamber 26 with a rotor assembly 28. The rotor assembly 28 includes a shaft 30, an annular support 32 mounted on the shaft 30, and plurality of circumferentially spaced beaters 34 extending from the annular support 32. See FIG. 1. The beaters 34 rotate, preferably at high speeds, through the grinding chamber 26 at a defined rotation path 36 to induce high velocity currents (not shown) around the grinding chamber 26. Additionally, the pulverizer 14 includes a cover 38 which is an imperforate circumferential wall 40 extending generally 180° about the grinding chamber 26, a material inlet end 42 extending through the cover 38, a material discharge end 44, and a support frame 46 for supporting the cover 38 and the apparatus 10. This support frame 46 is configured to receive the series of bars 18 thereon for locking the apparatus 10 within the pulverizer 14. Illustratively, the pulverizer 14 may be a Bantam™ Mikro-Pulverizer, W., or gravity type (MikroPul, Division of The Slick Corp., Summit, N.J.). It is however contemplated, that the pulverizer 14 may be a center feed type pulverizer with a horizontal feed screw (not shown) or one of a wide variety of impact pulverizing devices generally available in the area of impact grinding formed to support conventional screening elements (not shown).

Preferably, the support frame 46 of pulverizer 14 includes mounting flanges 48, 50 positioned on opposite sides 52, 54 of the grinding chamber 26 to support the apparatus 10 thereon. The apparatus 10 includes opposite ends 56, 58 mounted on the flanges 48, 50. Ideally, the series of bars 18 extends about the periphery of the chamber 26 between the opposite sides 52, 54. The series 18 includes a first bar 60 at the first end 56 resting upon the first flange 48 and a final bar 62 positioned between the first bar 60 and the second end 58. See FIG. 1. It is contemplated that the series of bars 18 may extend between the opposite ends 56, 58 of the apparatus 10 and have the first bar 60 resting on the first flange 48 and the final bar 62 resting upon the second flange 50 (not shown). The series of bars 18 are positioned within the pulverizer 14 so that they are circumferentially angled about the periphery of the grinding chamber 26 generally parallel to the tangent of the rotation path 36 of the beaters 34 defined at each bar as shown in FIG. 1. It is further contemplated however that the bars 18 may be positioned from generally parallel to the tangent of the rotation path 36 to about 45 degrees away from tangent. Preferably, the bars 18 are positioned from about 30 to about 45 degrees away from the tangent of the rotation path 36. Ideally, the bars 18 are formed to include a hardfacing (not shown) to protect against wear from various materials 12 placed within the grinding chamber 26.

Each bar 20, 22 in the series 18 includes a radially inner side 64, a radially outer side 66, and an impact edge 68 and a trailing edge 70 extending between the radially inner side 64 and the radially outer side 66. The bars 20, 22 are positioned with respect to the grinding chamber 26 so that the radially inner side 64 of each leading bar 20 in the series 18 is generally overlapped by the radially outer side 66 of an adjacent bar 22 in the series 18. Moreover, the discharge gap 24 extends between the radially inner side 64 of the leading bar 20 and the radially outer side 66 of the adjacent bar 22. Ideally, the gap 24 is positioned between the radially inner side 64 of the leading bar 20 and the impact edge 68 of the adjacent bar 22. The impact edges 68 of the bars 20, 22 are each positioned so as to be generally perpendicular to the rotation path 36 of the beaters 34. The impact edge 68 is positioned within the grinding chamber 26 and the trailing edge 70 is positioned within the discharge end 44 of the pulverizer 14.

Figure 2:
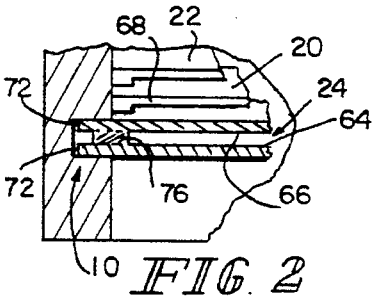
FIG. 2 is an enlarged sectional view of the bars of FIG. 1, showing a weld joint extending between a radially inner side of a leading bar and a radially outer side of an adjacent bar in the series.
Figure 3:
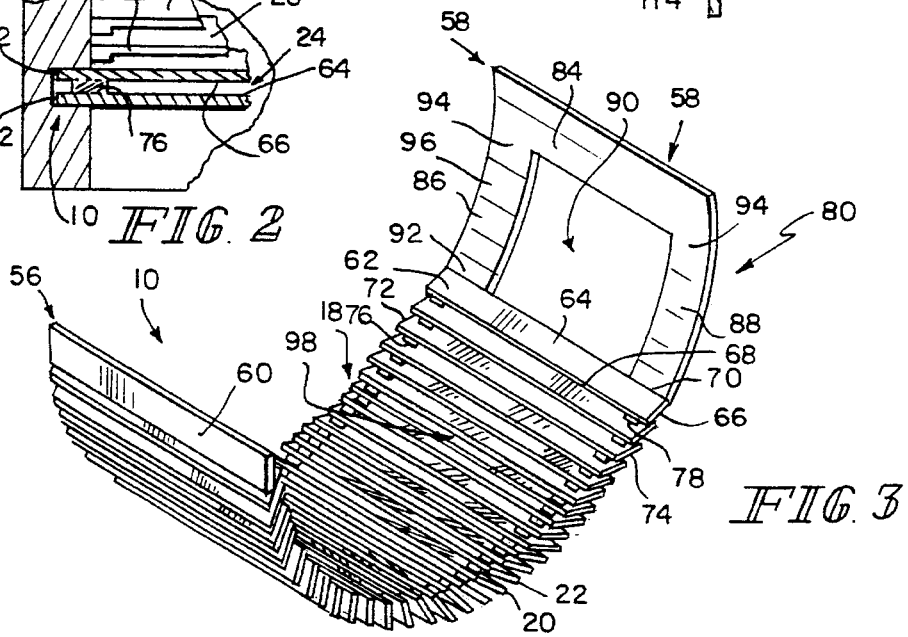
FIG. 3 is a perspective view of the comminuting apparatus of FIG. 1.

Additionally, each illustrative bar 20, 22 is generally rectangular in shape and includes opposite coupling ends 72, 74, see FIGS. 2 and 3. Referring now to FIG. 3, the impact 68 and trailing 70 edges extend across the length of each bar 20, 22 between the opposite coupling ends 72, 74. Moreover, the bars 20, 22 in the series 18 are coupled together at each opposite coupling end 72, 74. Preferably, a first weld joint 76 extends between the first coupling ends 72 of adjacent bars 20, 22 in the series 18 and a second weld joint 78 extends between the second coupling ends 74. As best shown in FIG. 2, the illustrative weld joint 76 extends between the radially inner side 64 of the leading bar 20 and the radially outer side 66 of the adjacent bar 22, each at their ends 72. Note, the weld joint 76 provides support for forming the gap 24 between each leading bar 20 and adjacent bar 22 in the series 18. While welding is illustrated, it will be appreciated that a variety of fastening approaches may be used to connect adjacent bars 20, 22.

As best shown in FIG. 3, the comminuting apparatus 10 further comprises a material discharge portion 80 to dispel from the grinding chamber 26 ungrindable softened materials 82. This discharge portion 80 includes a frame mount 84, generally parallel curved branches 86, 88, and a material discharge aperture 90 extending between the branches 86, 88. The frame mount 84 of the discharge portion 80 ideally forms the second opposite end 58 of the apparatus 10 and rests upon the second flange 50, see for example FIG. 1. The branches 86, 88 themselves (see FIG. 3) include an inner end 92 coupled to the final bar 62 of the series 18, an outer end 94 fixed to the frame mount 84, and a middle portion 96 formed to extend between the series 18 and the frame mount 84. The first branch 86 extends in a generally perpendicular direction from the first coupling end 72 of the final bar 62 and the inner end 92 of the second branch 88 extends from the second coupling end 74 of the final bar 62. The number of bars 20, 22 in the series 18 depends upon the size of the grinding chamber 26 and the product to be produced. Typically, the series 18 includes at least 3 bars 20, 22 and can include as many as 100 or more bars 20, 22.

Figure 4:
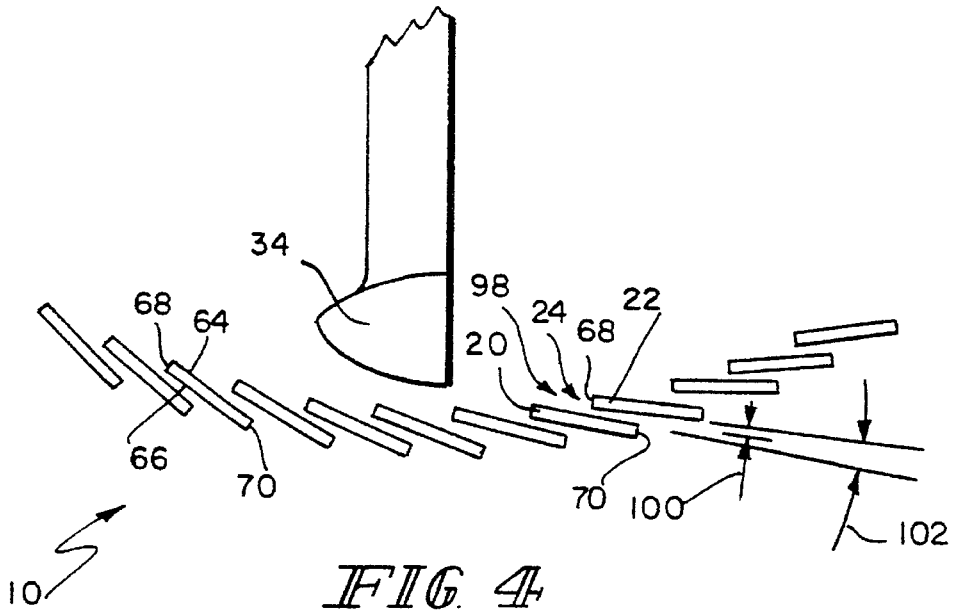
FIG. 4 is a diagrammatic view of the comminuting apparatus of FIG. 1, showing a material discharge gap formed between adjacent bars in the series and a flow path generally parallel to the tangent of the rotation path of the beaters and showing the flow path having a first width and a second increased width.

Referring now to FIG. 4, the material discharge gap 24 is formed between each leading bar 20 in the series 18 and the impact edge 68 of each adjacent bar 22 to create a flow path 98. This flow path 98 is generally parallel to the tangent of the rotation path 36 of the beaters 34. Moreover, the flow path 98 is formed to have a first width 100 between the radially inner side 64 of the leading bar 20 in the series 18 and the impact edge 68 of the adjacent bar 22. This first width 100 can be varied depending upon what material is to be pulverized. Typically, the width 100 ranges from 1/32 inches to about 1/4 inches. To achieve 40–60 mesh rubber, the width 100 is preferably approximately 1/32 inch. Additionally, the flow path 98 increases in width as the path 98 approaches the discharge end 44 of the pulverizer 14. Thus, an increased second width 102 extends between the trailing edge 70 of the leading bar 20 and the radially outer side 66 of the adjacent bar 22 in the series 18.

Figure 5:
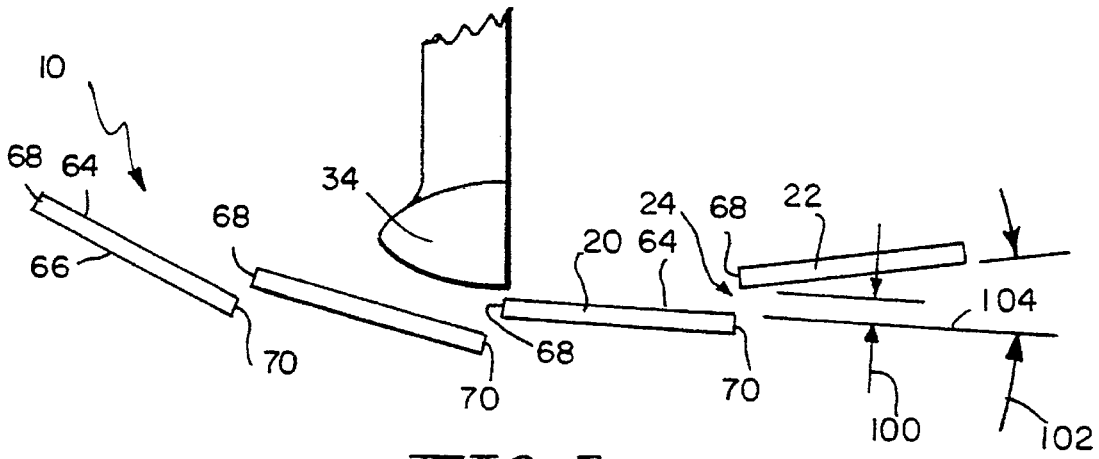
FIG. 5 is a sectional view of an alternative embodiment of the series of bars of FIG. 4 showing the material discharge gap formed between a trailing edge of a leading bar and an impact edge of an adjacent bar in the series and showing the flow path having a first width and an increased second width.

It is further contemplated that the illustrative material discharge gap 24 is formed between the trailing edges 70 of the leading bars 20 in the series 18 and the impact edges 68 of adjacent bars 22 so that the edges 68, 70 are in general alignment. See FIG. 5. The impact edge 68 remains generally perpendicular to the rotation path 36 of the beaters 34 and the flow path 98 increases in width, as it approaches the discharge end 44 of the pulverizer 14. Thus, the flow path 98 in the apparatus 10 with generally aligned impact edge 68, and trailing 70 edges includes a first width 100 positioned between the trailing edge 70 of each leading bar 20 and the impact edge 68 of each adjacent bar 22. The flow path 98 further includes a second increased width 102 between the trailing edge 70 of each adjacent bar 22 and a line 104 extrapolated from the radially inner side 64 of each leading bar 20.

When the materials 12 are inserted into the material inlet end 42, they illustratively have a length of approximately 1/2 inch and fall in a downward direction 106 through the material inlet end 42 and into the grinding chamber 26. See FIG. 1. Simultaneously, the high velocity currents (not shown), induced by the rapidly rotating beaters 34 traveling around the grinding chamber 26, carry the materials 12 toward the first opposite end 56 of the apparatus 10. While falling, these materials 12 pass into the path 36 of the rapidly rotating beaters 34 which strike and pulverize the materials 12. After the beaters 34 hit the materials 12, the high velocity currents (not shown) carry the materials 12 in a direction generally tangent to the rotation path 36 and toward the impact edges 68 of the bars 20, 22. These materials 12 then strike the impact edge 68 which further breaks-up the material 12 and deflects it into the rotation path 36 of the beaters 34 where it is efficiently impacted by said beaters 34. By arresting the movement of the material 12 in a direction generally parallel to the tangent of the beater path 36 and by imparting radially inward movement of the material 12 into the beater path 36, the beaters 34 are able to impart their maximum impact upon the material 12.

The material 12 is thus repeatedly struck by the beaters 34 and swept into engagement with the impact edges 68 of the bars 20, 22 in the series 18. The apparatus 10, however, will only retain materials 12 having a size greater than a selected fine material 108 within the grinding chamber 26. The reduced materials 108 which have been successfully pulverized to the desired reduced fineness are automatically released in a radially outward direction 110 from the grinding chamber 26 through the flow paths 98 created between the adjacent bars 20, 22 in the series 18. The reduced fine materials 108 freely pass through the flow path 98 at an angle generally parallel to the tangent of the rotation path 36 of the beaters 34. The width 100 of the gap 24 at the beginning of the flow path 98 is preferably sized to allow a portion of currents (not shown) created within the grinding chamber 26 to stream through the flow paths 98 to carry the reduced fine materials 108 into the discharge end 44 of the pulverizer 14. Additionally, a second portion of the currents (not shown) flows over the series 18 between the beaters 34 and the impact edges 68 so that the materials 12 which deflect off of the impact edge 68 are carried toward the rotation path 36 of the beaters 34.

A wide variety of brittle materials 12 may be pulverized with the comminuting apparatus 10 in accordance with the present invention. Examples of suitable materials 12 include sugar, spices, limestone, coal, brittle rubber, rubber compounds, brittle butyl rubber, and various other thermoset and thermoplastic materials. This list of compounds is not however exhaustive, as a wide variety of materials 12 may be pulverized. Organic materials 12, however, are pulverized at a temperature preferably near or below their Tg. It is important that the organic materials 12 be near or below their Tg in the grinding chamber 26 because as the temperature of the material 12 rises increasingly above Tg, the material 12 loses its brittleness, and becomes rather soft and gummy. A soft material 82 is less likely to break up into the desired small fragments and bounces around in the chamber 26 adding heat to the materials 12 within the grinding chamber 26.

Thus, in preferred embodiments, apparatus 10 not only releases the reduced fine material 108, but also discharges materials 82 in a radially outward direction 112 whose temperatures are much above the Tg of the like material 12 in the inlet end 42 grinding chamber 26. The apparatus 10 discharges the material 82 having the increased temperature through the material discharge aperture 90 positioned between the series of bars 18 and the branches 86, 88 of the material discharge portion 80. Generally for brittle butyl rubber, about 98% of the material 12 is pulverized and then passes between the bars 20, 22 and about 2% of the material 12 becomes soft and is discharged through the material discharge aperture 90. The warm material 82 is repeatedly hit by the beaters 34, swept into engagement with the impact edges 68, and deflected into the rotation path 36 of the beaters 34 until the material 82 makes approximately one passage across the series of bars 18. At that time, the material 82 is swept into the material discharge portion 80. Preferably, the apparatus 10 further includes a partitioning device 114 for separating the reduced fine material 108 which passes through the flow path 98 from the materials 82 passing through the discharge aperture 90. Illustratively, this partitioning device 114 may be a partitioning bag. It is however contemplated that the material 12 may be separated utilizing a network of screens each having a different mesh or other comparable separating devices.

In practice of the method of the present invention, the material 12 is inserted into the inlet end 42 of the pulverizer 14. The rotating beaters 34 strike the material 12 to beat the material 12 to the selected reduced fineness 108. The material 12 is then impacted against the series of bars 18, each having an impact edge 68. Reduced fine materials 108 pass out of the grinding chamber 26 between the radially inner side 64 of one of the leading bars 20 and the radially outer side 66 of the adjacent bar 22. Completely unreduced, or materials 12 having a greater size than that of the selected reduced fine materials 108 are deflected off of the impact edge 68 and into the rotation path 36 of the beaters 34 for additional grinding.

The method in accordance with the present invention may include the step of selecting a brittle material 12. The material 12 may be brittle as is, without further processing. However, it is also contemplated that the material 12 may be made brittle by cooling the material 12 until it is near or below the Tg for the material 12. The material 12 may be cooled using a variety of cooling techniques available in the marketplace such as contacting the material 12 with a cold compound (not shown). Further examples include cooling techniques such as refrigeration or tumbling. For materials 12 with a low Tg, such as butyl rubber, the material 12 is preferably placed in a tumbler (not shown) with liquid nitrogen having a temperature of about −195.79° C. For materials 12 with a slightly higher Tg, the materials 12 are preferably placed in a tumbler with carbon dioxide snow (dry ice) having a temperature of at least −78.5° C. or liquid air. It is contemplated, however, that the material 12 may be contacted with a wide variety of cooling compounds available in the marketplace. Thus, the brittle material 12 will break apart within the grinding chamber 26 using very little energy. Having the material 12 near or below its Tg prevents the material 12 from gumming up, softening, and clogging up the flow path 98 for the reduced fine materials 108.

The method further contemplates the step of discharging materials 82 having a temperature much above the Tg of said material 82, from the grinding chamber 26 after approximately one passage across the series 18 of bars 20, 22. This discharging step includes the material 82 falling through the material discharge aperture 90 formed between the branches 86, 88 of the discharge portion 80. Further, the material 82 passing through the material discharge aperture 90 may be partitioned from the material 108 passing between the bars 20, 22 in the series 18 and having the selected reduced fineness. The material 82 may then be returned to the cooling apparatus (not shown) to return its temperature to near or below the Tg. Therefore, the resulting embrittled materials 12 are returned to grinding chamber 26 through the inlet end 42 of the pulverizer 14.

Although the invention has been described in detail with reference to certain preferred embodiments, variations and modifications exist within the scope and spirit of the invention as described and defined in the following claims.

What is claimed is:

1. A method for reducing the particle size of materials in an impact pulverizing machine having a circumferential grinding chamber which includes a plurality of circumferentially spaced beaters having a rotation path therein, a material inlet end, a material discharge end, and a support frame, said method comprising the steps of inserting material into the inlet end, striking the material with the beaters to break the material from a small size to a reduced fineness, impacting the material against a series of circumferentially spaced bars, each bar having an impact edge generally perpendicular to the rotation path of the beaters, a radially inner side circumferentially angled about the periphery of the grinding chamber generally parallel to a tangent of the beating means, each respective tangent being defined adjacent to the impact edge of each bar, and an opposite radially outer side, permitting materials having a selected reduced fineness to pass between the radially inner side of a leading bar in the series and the radially outer side of an adjacent bar to exit the grinding chamber, and deflecting materials having a size greater than that of the selected reduced fineness off of the impact edge and into the rotation path of the beaters.

2. The method of claim 1, wherein the inserting step further includes the step of inserting the material at a temperature near or below the glass transition temperature of said material.

3. The method of claim 2, further comprising the step of cooling the material to near or below the glass transition temperature of said material.

4. The method of claim 3, wherein the selecting step includes the step of choosing the material from the group consisting of sugar, spices, limestone, coal, rubber, rubber compounds, thermoset and thermoplastic materials, and butyl rubber.

5. The method of claim 4, wherein the material is butyl rubber.

6. The method of claim 3, wherein the cooling step further includes the step of contacting the material in a compound selected from the group consisting of dry ice, liquid nitrogen, and liquid air.

7. The method of claim 6, wherein the compound is liquid nitrogen.

8. The method of claim 2, further comprising the step of providing a material discharge portion adjacent the series of bars, the discharge portion having a mounting portion engaging the support frame, opposite curved branches coupled to the series and extending generally parallel to one another between the series and the mounting portion, and a material discharge aperture extending between the branches.

9. The method of claim 8, further comprising the step of releasing softened materials through the material discharge aperture.

10. The method of claim 9, wherein the releasing step further includes the step of partitioning the material passing through the material discharge aperture from the material having the selected reduced fineness.

11. A comminuting apparatus for use in an impact pulverizer having a circumferential grinding chamber which includes a plurality of circumferentially spaced beaters having a rotation path therein, a material inlet end, a material discharge end, and a support frame, said apparatus comprising a series of bars circumferentially angled about the periphery of the grinding chamber, each bar being generally parallel to a tangent of the rotation path of the beaters defined at each bar, the bars in the series of bars being coupled together in a generally parallel overlapping relationship so that a material discharge gap is formed between adjacent bars in the series to create flow paths, each flow path being generally parallel to each respective tangent of the rotation path of the beaters defined at each flow path.

12. The apparatus of claim 11, wherein each bar includes a radially inner side, a radially outer side, and an impact edge extending between the radially inner side and the radially outer side across the length of the bar and the impact edge is generally perpendicular to the rotation path of the beaters.

13. The apparatus of claim 12, wherein the radially inner side of each bar is angled about the periphery of the grinding chamber from generally parallel to the tangent of the rotation path defined at the bar to about 45 degrees away from the tangent.

14. The apparatus of claim 13, wherein the radially inner side of each bar is angled about the periphery of the grinding chamber from about 30 to about 45 degrees away from the tangent of the rotation path defined at the bar.

15. The apparatus of claim 12, wherein each bar includes opposite coupling ends and the bars are mounted together by a first weld joint extending between the first opposite coupling ends of adjacent bars in the series and a second weld joint extending between the second opposite coupling ends of adjacent bars in the series.

16. The apparatus of claim 12, wherein the bars are generally rectangular in shape and each bar includes a trailing edge extending across the length of the rectangular bar opposite the impact edge.

17. The apparatus of claim 16, wherein the trailing edge of a leading bar in the series is overlapped by the radially inner side of an adjacent bar in the series and the discharge gap is formed to extend between the radially inner side of the leading bar and the radially inner side of the adjacent bar.

18. The apparatus of claim 17, wherein the flow path is formed to have a first width between the radially inner side of the leading bar and the impact edge of the adjacent bar and an increased second width between the trailing edge of the leading bar and the radially inner side of the adjacent bar.

19. The apparatus of claim 11, wherein the support frame is formed to include flanges and the series is supported on the frame by opposite ends, a first bar in the series is mounted on the first flange and the second opposite end is mounted on the second flange.

20. The apparatus of claim 19, wherein the bars are generally rectangular in shape and include an impact edge and an opposite trailing edge extending across the length of the rectangle, the impact edge is positioned generally perpendicular to the rotation path of the beaters.

21. The apparatus of claim 20, wherein the impact edge of each bar faces the grinding chamber and the trailing edge of each bar faces the discharge end.

22. The apparatus of claim 20, wherein the bars include an impact edge generally perpendicular to the rotation path of the beaters and the material discharge gap is positioned between a leading bar in the series and the impact edge of an adjacent bar.

23. The apparatus of claim 22, wherein the flow path is formed to include a first width between each leading bar and the impact edge of each adjacent bar in the series, the first width being between approximately 1/32 of an inch and 1/4 of an inch.

24. The apparatus of claim 23, wherein the flow path is further formed to include an increased second width between the leading bar and the adjacent bar in the series.

25. The apparatus of claim 11, further comprising a material discharge portion formed to include a frame mount, generally parallel curved branches, each having an inner end coupled to the series and an outer end fixed to the frame mount, and a material discharge aperture formed to extend between the branches.

26. The apparatus of claim 25, wherein the bars include opposite coupling ends and a middle portion extending therebetween and the inner end of the first branch extends in a generally perpendicular direction from the first opposite coupling end of a final bar in the series and the inner end of the second branch extends from the second opposite coupling end of the final bar.

27. The apparatus of claim 25, wherein the series includes at least 3 bars.

28. A comminuting apparatus for use in an impact pulverizer having a circumferential grinding chamber which includes means for beating brittle materials so that the materials are converted from a small size to a reduced fineness, a material inlet end, a material discharge end, and a support frame, said apparatus comprising means for retaining the brittle material in the interior grinding chamber until it is pulverized to the reduced fineness, said retaining means being mounted on the support frame and comprising a series of bars circumferentially angled about the periphery of the grinding chamber, each bar being generally parallel to each respective tangent of the beating means defined at each bar, each bar having surface means for pulverizing the brittle material to the reduced fineness and for deflecting the brittle material into engagement with the beating means, and the bars being coupled together to create a material flow path between adjacent bars in the series so that the reduced fine materials are released from the retaining means into the material discharge end.

29. The apparatus of claim 28, wherein the bars are generally rectangular and include a radially inner side generally parallel to the tangent of the beating means and a radially outer side, and the surface means is positioned between the radially inner side and the radially outer side generally perpendicular to the beating means.

30. The apparatus of claim 29, wherein the bars include opposite ends and the surface means extends between the opposite ends.

31. The apparatus of claim 30, wherein the surface means is an impact edge facing the grinding chamber.

32. The apparatus of claim 29, wherein the bars are arranged in general overlap relation to one another and the material flow path is positioned between the radially inner side of a leading bar in the series and the radially outer side of an adjacent bar in the series.

33. The apparatus of claim 32, wherein the material flow path is positioned generally parallel to the tangent of the beating means.

34. The apparatus of claim 28, wherein the material is near or below the glass transition temperature of said material in the inlet end and the apparatus further includes means for releasing softened material into the discharge end.

35. The apparatus of claim 34, wherein the apparatus further includes mean for partitioning the material passing through the releasing means from the material passing through the material flow path.

36. The apparatus of claim 35, wherein the partitioning means is a partitioning bag.

37. The apparatus of claim 34, wherein the releasing means is a material discharge portion, said discharge portion is formed to include a mounting portion sized for engagement with the support frame, opposite curved branches coupled to the series and extending generally parallel to one another between the series and the mounting portion, and a material discharge aperture extending between the branches.

38. The apparatus of claim 37, wherein the bars include opposite coupling ends and a middle portion extending therebetween and the first branch extends in a generally perpendicular direction from the first opposite coupling end of a last bar in the series and the second branch extends from the second opposite coupling end of the last bar.

39. The apparatus of claim 38, wherein the bars are mounted together along adjacent first opposite coupling ends and along adjacent second opposite coupling ends.

40. The apparatus of claim 38, wherein the bars are mounted together by a first weld joint extending between adjacent first opposite coupling ends and a second weld joint extending between adjacent second opposite coupling ends.

41. A comminuting apparatus for use in an impact pulverizer comprising a cover defining a grinding chamber, a support frame connected to the cover and defining a discharge space, and a series of spaced-apart bars circumferentially angled about a generally cylindrical path positioned between the grinding chamber and the discharge space, each pair of bars in the series of bars defining a material discharge gap and the series of bars defining a series of spaced-apart material discharge gaps between the bars, each gap defining a flow path having an inner side in fluid communication with the grinding chamber and an outer side in fluid communication with the discharge space, each flow path extending in a direction generally parallel to a tangent to the cylindrical path defined at the inner side of each respective flow path.

42. The apparatus of claim 41, wherein each bar includes a radially outer side adjacent the discharge end, a radially inner side adjacent the grinding chamber, an impact edge positioned within the grinding chamber and connecting the radially outer and inner sides, the radially inner side of a leading bar cooperating with an impact edge of a bar adjacent to the leading bar to define a first end of the flow path.

43. The apparatus of claim 42, wherein the radially inner side of the leading bar cooperates with the impact edge of the bar adjacent to the leading bar to define a first end of the flow path having a width between approximately 1/32 of an inch and approximately 1/4 of an inch.

44. The apparatus of claim 42, wherein the impact edge of each bar is generally perpendicular to a tangent to the cylindrical path defined at the impact edge of each bar.

45. The apparatus of claim 41, wherein the flow path extends in a direction at an angle to the tangent, the angle being between 0 and 45 degrees.

46. The apparatus of claim 45, wherein the angle is between 30 and 45 degrees.

47. A comminuting apparatus for use in an impact pulverizer comprising a cover defining a grinding chamber, a support frame connected to the cover and defining a material discharge space, and a screen defining a series of flow paths spaced apart about a generally cylindrical path for directing material therethrough, each flow path having an inner side in fluid communication with the grinding chamber and an outer side in fluid communication with the discharge space, and each flow path extending in a direction generally parallel to a tangent to the cylindrical path defined at the inner side of each respective flow path.

48. The comminuting apparatus of claim 47, wherein the inner side of each flow path has a width between approximately 1/32 of an inch and approximately 1/4 of an inch.

49. The comminuting apparatus of claim 47, wherein each flow path extends in a direction at an angle to the tangent, the angle being between 0 and 45 degrees.

50. The apparatus of claim 49, wherein the angle is between 30 and 45 degrees.

* * * * *